United States Patent [19]

Lazanas

[11] 3,992,723

[45] Nov. 23, 1976

[54] HAND PUMPED VENTILATING SYSTEM FOR HAND COVERING

[76] Inventor: Panayiotis A. Lazanas, 1, Doras Distria Str., Athens 140, Greece

[22] Filed: May 5, 1975

[21] Appl. No.: 574,289

[30] Foreign Application Priority Data

Sept. 2, 1974 Greece ..... 94816

[52] U.S. Cl. ..... 2/161 R

[51] Int. Cl.[2] ..... A41D 19/00

[58] Field of Search..... 2/158, 159, 161 R, 161 A, 2/168, 16–20

[56] References Cited

UNITED STATES PATENTS

| | | | |
|---|---|---|---|
| 1,206,102 | 11/1916 | Gibson | 2/168 |
| 1,578,127 | 3/1926 | Hynes | 2/158 |
| 3,121,877 | 2/1965 | Gintner | 2/159 |
| 3,259,914 | 7/1966 | Johnson | 2/161 R |
| 3,342,182 | 9/1967 | Charos | 2/161 R |
| 3,564,614 | 2/1971 | Getchell et al. | 2/161 R |
| 3,649,966 | 3/1972 | Shields | 2/159 |
| 3,801,988 | 4/1974 | Marcam et al. | 2/161 R |

*Primary Examiner*—G. V. Larkin

*Attorney, Agent, or Firm*—Brooks Haidt Haffner & Delahunty

[57] ABSTRACT

A hand covering, such as a glove, is provided having a ventilating system with an air chamber which is valve controlled to pump air in one direction past the fingertips of the user upon flexing of the hand.

5 Claims, 9 Drawing Figures

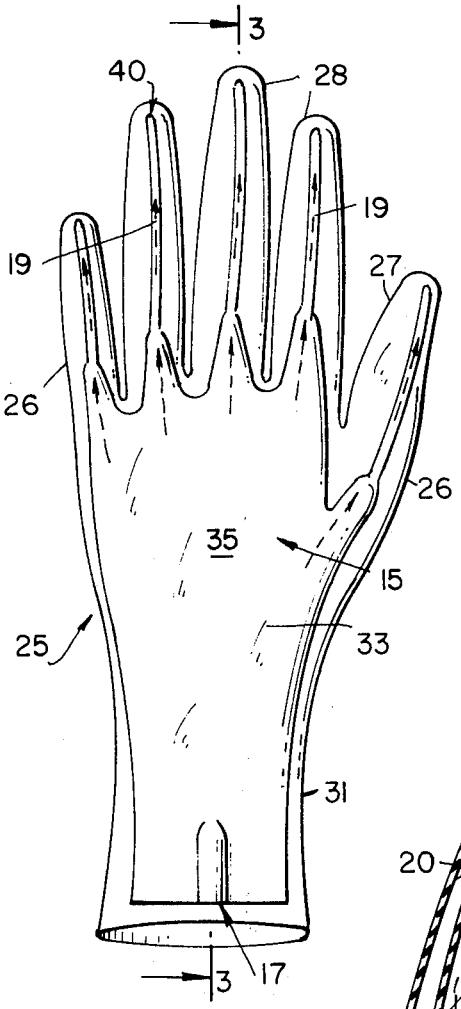
FIG. 1
FIG. 3
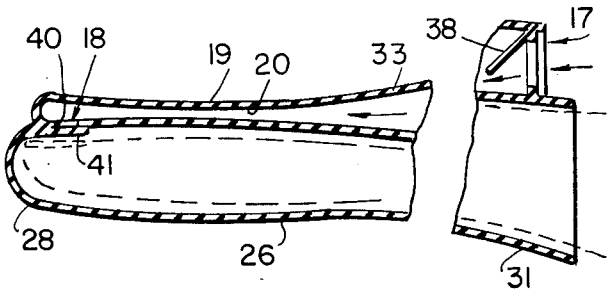
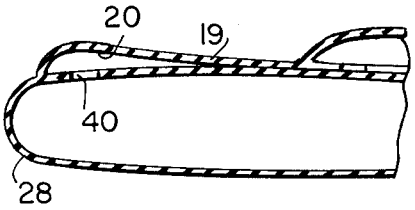
FIG. 4
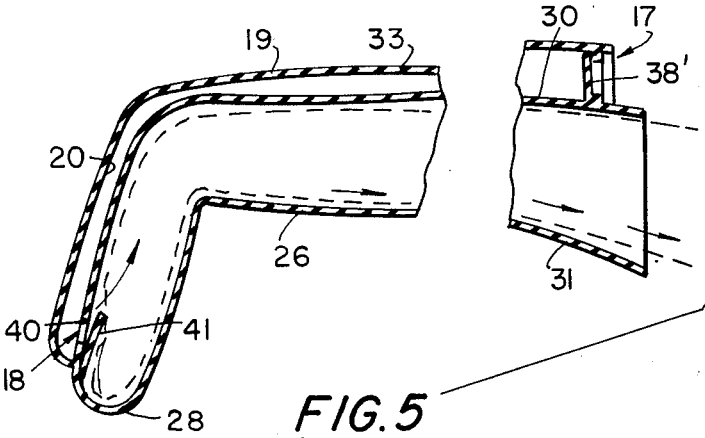
FIG. 5
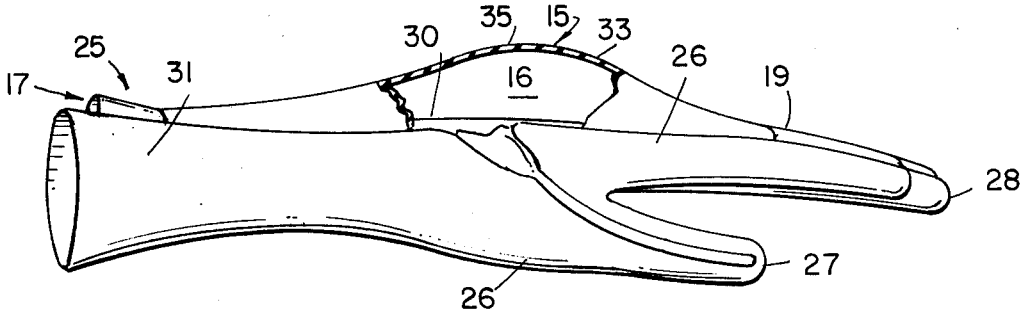
FIG. 2

HAND PUMPED VENTILATING SYSTEM FOR HAND COVERING

BACKGROUND OF THE INVENTION

The need for the provision of a flow of air through a glove to remove moist air and the like has been recognized in the fields of medicine, research, equipment operation and the like. Attempts to meet this need are exemplified by the patent to Gibson of 1916, U.S. Pat. No. 1,206,102 wherein air is identified as being drawn in and forced out of the glove through the same wrist opening. Circulation to the fingers, let alone the fingertips, is at best inefficient and somewhat doubtful. Another patent of interest is the 1964 patent to Gintner, U.S. Pat. No. 3,121,877 wherein a full flow is provided over the fingertips between periods of activity by activating an external air system including a source of compressed air. The cumbersome equipment required to accomplish the desired one-way full airflow does not afford the user the freedom needed for many uses of such a glove.

OBJECTS OF THE INVENTION

The objects of this invention are the provision of a hand covering, such as a five fingered glove, equipped with an air chamber on the back thereof which the wearer causes to be collapsed and expanded through a valving system to pump air in one direction over the full hand of the wearer. Pumping of air is accomplished when the wearer flexes his hand, the fingers being particularly effective in pumping the air.

Another object is the provision of valving systems which are critical to the realization of an inexpensively manufactured glove by one-piece molding, laminating, etc.

When handling an instrument, the thumb portion and some of the finger portions may be required to remain in a non-pumping position for a period of time; however, the finger portions (those not needed) will be available to stress and unstress the panel to move air through the system.

The glove can be of a material which does not have a memory or resiliency to return to a set shape after distortion. Such a glove would be the typical surgeon's glove. In such a case a panel of suitable material is added to the glove to produce the required outward bellying to form the air chamber during suction (when the wearer's hand is straightened).

DESCRIPTION OF THE DRAWINGS

FIG. 1 is a view of the back part of a hand covering, a glove, showing a ventilation system wherein outside air is drawn into an air chamber through a swingable flap valve and exhausted through the fingertips into the interior of the glove;

FIG. 2 is a sideview of the glove shown in FIG. 1;

FIG. 3 is an enlarged, fragmentary cross-section taken on line 3—3 through a finger portion and the wrist portion of the glove shown in FIG. 1 showing outside air being drawn into the air chamber when the hand is straightened, the air chamber external valve being open and the fingertip valve being closed, the central part of the glove being broken away for clarity;

FIG. 4 is a view similar to that of FIG. 3 but of a glove modified to place the finger passages inside the normal glove shape and utilizing its collapsed walls as a replacement of the fingertip valve of FIG. 3;

FIG. 5 is a view similar to that of FIG. 3 showing the air chamber external valve closed and the fingertip internal valve open when the wearer's hand is clenched to pump air through the glove, the external valve being a bottom hinged modification of the FIG. 3 valve;

Figure 6:
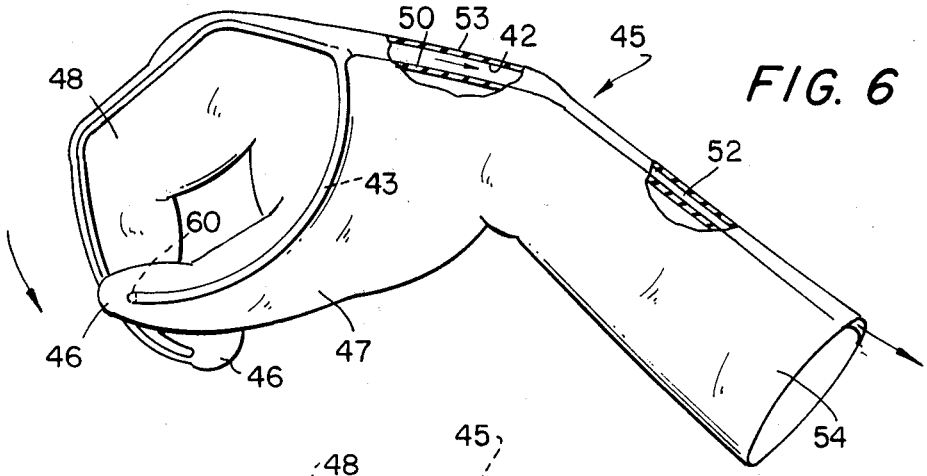
FIG. 6 shows a modification of a glove wherein outside air is drawn into the glove and exhausted through the air chamber to the outside through an external blowthrough vent valve, the air chamber being shown in collapsed condition with the hand clenched.

The invention relates to the manufacture of rubber gloves intended for domestic, industrial, medical and other uses, each glove being equipped with a self-contained air pump which is caused to function by the natural movements of the hand and/or wrist of the wearer. The air pump, in one arrangement, draws air from the outside and discharges it through the interior of the glove. Alternatively, and after some experimentation, preferably, the pump is arranged to draw air from the interior of the glove and to discharge the air from the glove to the outside.

FIG. 1, which is illustrative of the first arrangement, shows an air pump 15 formed by a rubber air chamber 16 attached to the upper external (back) surface of a glove 25. The shape of pump 15 in part simulates the glove and hand. An inlet valve 17 and five outlet valves 18 are provided. Five rubber tubes 19 extend from the air chamber to the end of each finger, that is, to the fingertip, where each tube 19 is connected to the interior of its associated finger portion of the glove through an outlet valve 18.

On every bend of the fingers and/or the wrist, air chamber 16 is compressed and forces the air which is in it through the tubes 19 into the inside of the glove at the end of each finger. During such movement the inlet valve 17 is shut and the outlet valves 18 are opened. During the reverse movement, i.e., when the fingers and wrist are straightened, air chamber 16 retakes its original shape motivated by the resilience of the rubber of which it is made. During the straightening of the fingers and/or the wrist the outlet valves 18 are closed and the inlet valve 17 is opened to permit fresh air to be drawn from the outside into chamber 16.

Since the wearer of the glove makes constant movements with his fingers and wrist whatever work he is doing, a continuous air draft is created from the outside to the inside of the glove. The air which is inside the glove is forced out by the incoming air current from the ends of the fingers through the opening within the glove about the wrist of the wearer. In other words, a continuous renewal of the air of the interior of the glove is attained.

The continuous renewal of air inside the glove prevents the saturation of the air by concentrates which come from the sweat of the hands of the wearer. This gives the wearer a feeling of well-being.

The use of the subject gloves of rubber or the like eliminates or reduces the undesirable consequences of frequent use of common rubber gloves. Irritation of the skin and the like are minimized.

Referring to FIGS. 1–5, the hand covering, i.e., rubber glove 25, has five fingertip portions 26 which include a thumb portion 27 and four finger portions 28. A palm portion 29 forms a front face area of the glove, and a back portion 30 with a knuckle area extends from the finger portions toward the wrist portion 31 of glove 25.

An outer panel 33 of elastomeric material is peripherally sealed in airtight condition to the back portion 30 to define chamber 16. Panel 33 also separately extends over the four finger portions 28 and thumb portion 27 to form tubes 19 to provide air passages 20 which lead from outlet valves 18 to air chamber 16 and wrist portion 31. The peripheral seal of panel 33 to back 30 can be obtained through integral molding with back 30 or by laminating a separate outer panel 33 thereto or by other techniques. Preferably, the dome 35 of the outer panel 33 is formed of resiliently distortable material which, when distorted to a flattened condition upon hand clenching, is placed under stress whereby it automatically returns to its full domed shape of FIG. 2 when the hand is straightened.

External valve means 17, i.e., inlet valve 17, controls airflow between the outside and air chamber 16, formed by the outer panel dome 35 and underlying portion of the back portion 30.

As shown in FIG. 3, external valve 17 can be a flap valve 38 hingedly connected to the inside face of the outer panel 33. Alternatively, as shown in FIG. 5, valve 17 can be a flap valve 38' hingedly connected to back portion 30.

Internal valves 18, i.e., outlet valves 18, control airflow between air chamber 16 and fingertip portions 26 can, as shown in FIGS. 3 and 5, be formed by an opening 40 from passageway 20 into the interior of, for example, finger portion 28 of glove 25 having a flap 41 underlying opening 40. Alternatively, as shown in FIG. 4, valve 18 can be formed inside passageway 20 and flap 41 can be omitted, if the material forming tupe 19 permits it to collapse after bending the finger and while the finger is straightened, such that passageway 20 is in a closed valve condition temporarily until entry of air into air chamber 16 through valve 17 permits equalization of air pressure in chamber 16 and passageway 20.

FIGS. 6–9 are illustrative of the alternate, and presently preferred, arrangement in which the air pump withdraws air from the glove such that fresh air is drawn into the glove about the wrist of the wearer. In these FIGS. the reference numeral 45 generally designates a glove similar to glove 25 described with reference to FIGS. 1–5, having fingertip portion 46 on a thumb portion 47 and four finger portions 48. Glove 45 is also provided with a panel 53, similar to panel 33, peripherally secured to the back 50 of glove 45 to form an air chamber 42 and to thumb 47 and finger 48 portions to form passageways 43 leading from chamber 42 to fingertip portions 46 where passageways 43 communicate with the inside of glove 45 through openings 60.

The various passageways 43 are provided with inlet valves 51 for permitting flow of air from passageways 43 into chamber 42 and for blocking flow in the reverse direction. Glove 45 is also provided with an outlet 52 in an air duct 55 formed between the wrist portion 54 of glove 45 and the portion of panel 53 overlying wrist portion 54. Valve 52 permits air flow from chamber 42 through duct 55 to outside glove 45 and blocks the reverse flow.

Figure 7:
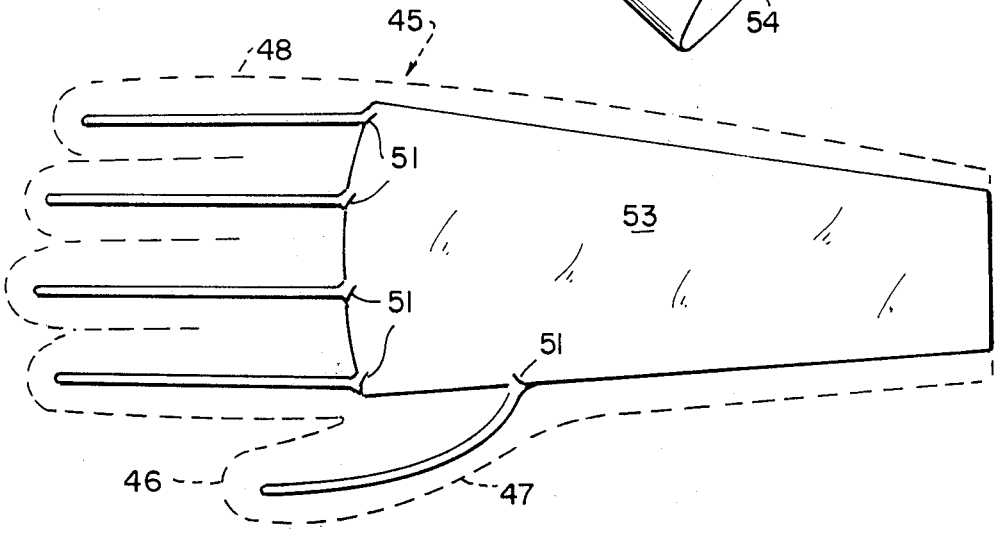
FIG. 7 is a bottom view showing the inside face of a back portion of a glove of the type shown in FIG. 6, showing the internal valves hinged to the sides of the inside ends of channels which lead air from the fingertips; the outer perimeter of the glove being shown in phantom.
Figure 8:
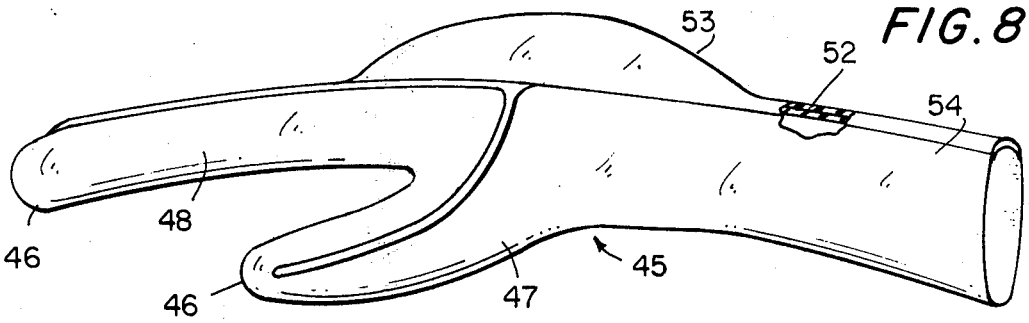
FIG. 8 is a side view of the glove shown in FIG. 6 illustrating the air chamber in expanded condition.

Thus, as is shown in FIG. 7, inlet valves 51 will be closed by the creation of air pressure in chamber 42. Also, as shown in FIG. 6, the creation of air pressure in chamber 42 will force valve 52 to open and air in chamber 42 will be expelled through the valve 52 to the atmosphere. The reverse movement caused by straightening of the hand of the wearer (see FIG. 8) forces resilient panel 53 to bulge away from the underlying back portion 50 of glove 45. This creates a partial vacuum in chamber 42 drawing panel 53 against wrist portion 53 to close valve 52 and at the same time opening valves 51 to draw air through openings 60 at the ends of air passages 43 from between glove 45 and the hand of the wearer into air chamber 42. The space between the hand of the wearer and glove 45 thus evacuated is refilled with air entering between the wrist of the wearer and wrist portion 53 of glove 45, such that a circulation of air is induced between the glove and the hand of the wearer upon continued flexing of the hand and fingers.

Figure 9:
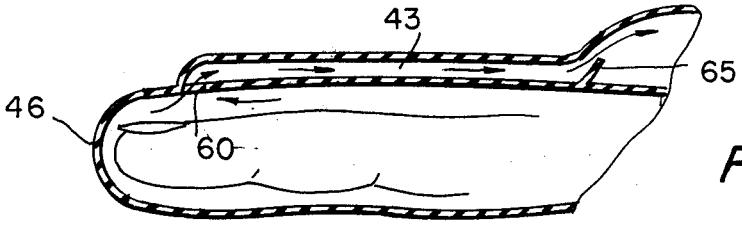
FIG. 9 is a cross-section similar to that of FIGS. 3 and 4 of a finger portion of a glove of the type shown in FIGS. 6–8 showing an internal valve hinged to the finger portion and not to the back panel.

FIG. 9 shows a variation of glove 45 in which the internal valve is in the form of a flap 65 hinged to the knuckle area of the glove.

In use, the invention enables the user to pump air over his hand at will or during normal flexing of the hand. The one-way flow of air is controlled by external valve means connecting the air chamber to the outside and internal valve means connecting the air chamber to a fingertip portion. The two directions of airflow are made possible by the various valve means shown in FIG. 1–9.

I claim:

1. An elastomeric glove adapted for pumping air over the wearer's hand when flexed comprising:

a wrist portion, four finger portions, a thumb portion, a palm portion joining said finger, thumb and wrist portions to form a front face area of the glove, and a back portion joining said finger, thumb and wrist portions including a knuckle area extending from said finger portions toward said wrist portion;

an outer panel of elastomeric material having the characteristic of independently returning to its original unstressed shape after being resiliently distorted, said panel being peripherally joined to the back portion in airtight condition and extending from said four finger portions and said thumb portion, the panel at said knuckle area being spaced from said back portion and in unstressed condition when the finger portions are extended to a straightened condition to form an air chamber with said back portion;

valve means for controlling airflow between the outside and the air chamber;

passages extending from the air chamber to the ends of the finger portions and the thumb portion;

valve means for controlling airflow between the air chamber and the passages;

said panel being resiliently distortable into a stressed condition upon bending the finger portions whereby air is pumped out of the air chamber, said panel on resiliently returning to its unstressed condition drawing air into the air chamber;

said wrist portion allowing airflow between the outside and inside of the glove upon pumping and suction of air.

2. An elastomeric glove as defined in claim 1, and wherein said first named valve means is an outlet valve means to the outside and is a swingable flap valve; and said second named valve means are swingable flap valves.

3. An elastomeric glove as defined in claim 1, and wherein said first named valve means is a blow-through vent valve to the outside and said second named valve means are swingable flap valves allowing air from the tips of the finger portions and the thumb portion to the air chamber.

4. An elastomeric glove as defined in claim 1, and wherein said first named valve means is a swingable flap valve allowing air entry from the outside on suction, and said second names valve means are blow-through valves formed by collapsible passages allowing airflow to the tips of the finger portions and the thumb portion from the air chamber.

5. In combination with a hand covering having at least one fingertip portion, means extending over the back panel of the hand covering including the fingertip portion and connected thereto to form an air chamber with the back of the hand covering, said means, at the knuckle area thereof, being resiliently biased to form a dome over the back of the hand covering when the wearer flexes his fingers to a straightened condition, thereby flattening the back of the hand covering, said panel being adapted to be forced toward a face-to-face engagement with the back when the wearer flexes his fingers toward a clenched condition, thereby bending the back of the hand covering and collapsing the air chamber to pump air; and valve means connecting said air chamber to the outside, and valve means connecting said air chamber to said fingertip portion, both said valve means limiting airflow in one direction between the outside and internally of the hand covering.

* * * * *